US006556125B1

(12) United States Patent
Röhrl

(10) Patent No.: US 6,556,125 B1
(45) Date of Patent: Apr. 29, 2003

(54) ACCESS CONTROL DEVICE FOR A MOTOR VEHICLE AND METHOD FOR SETTING THE SENSITIVITY OF AN ACCESS CONTROL DEVICE

(75) Inventor: Thomas Röhrl, Barbing (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/356,814

(22) Filed: Jul. 19, 1999

(30) Foreign Application Priority Data

Jul. 17, 1998 (DE) ..... 198 32 285

(51) Int. Cl.[7] ..... G08C 17/00
(52) U.S. Cl. ..... 340/5.62
(58) Field of Search ..... 340/5.61, 5.62, 340/5.63, 5.64, 5.72, 426, 10.1, 10.42, 825.69; 180/287; 343/711, 712, 713

(56) References Cited

U.S. PATENT DOCUMENTS 4,672,375 A * 6/1987 Mochida et al. ..... 340/5.64
4,760,394 A * 7/1988 Takeuchi et al. ..... 340/10.42
5,134,392 A * 7/1992 Takeuchi et al. ..... 340/5.62
5,157,389 A * 10/1992 Kurozo et al. ..... 340/5.61
5,517,189 A * 5/1996 Bachhuber et al. ..... 340/5.64
5,682,135 A * 10/1997 Labonde ..... 340/426
5,777,570 A * 7/1998 Kokubu ..... 340/5.61
5,844,470 A * 12/1998 Garnault et al. ..... 340/426
6,304,168 B1 * 10/2001 Ohta et al. ..... 340/5.72

FOREIGN PATENT DOCUMENTS

DE 3627193 A1 2/1987
DE 3536377 A1 4/1987
DE 4329697 A1 3/1995
DE 19516316 A1 11/1996
DE 19738560 A1 3/1998

* cited by examiner

*Primary Examiner*—Edwin C. Holloway, III
(74) *Attorney, Agent, or Firm*—Laurence A. Greenberg; Werner H. Stemer; Gregory L. Mayback

(57) ABSTRACT

An access control device for a motor vehicle and a method for setting the sensitivity of an access control device, include a plurality of ferrite antennas disposed in a door handle of the motor vehicle. The individual ferrite antennas are inclined with respect to one another and with respect to the door surface. Consequently, a widely fanned magnetic field is produced within which a request signal can readily be received by a portable encoder. In order to ensure that interference signals have only little effect on the reception of a request signal, the reception sensitivity of the encoder is increased only after a very powerful advance signal has been received.

11 Claims, 3 Drawing Sheets

ACCESS CONTROL DEVICE FOR A MOTOR VEHICLE AND METHOD FOR SETTING THE SENSITIVITY OF AN ACCESS CONTROL DEVICE

BACKGROUND OF THE INVENTION

Field of the Invention

The invention relates to an access control device for a motor vehicle in which access to the motor vehicle is permitted only when authorization is demonstrated. The invention also relates to a method for setting the sensitivity of the access control device.

An access control device which is known from German Published, Non-Prosecuted Patent Application DE 36 27 193 A1 has a transmitting and receiving unit in the vehicle. As required, the transmitting and receiving unit transmits a request signal and then waits for a reply signal from a portable encoder (question-answer dialog). If the reply signal is received, it is compared with an expected signal in an evaluation unit. If the two signals correspond, door locks are unlocked or an immobilizer is released.

In that case, the request signal is transmitted from an antenna in a side mirror when the user actuates a switch on the door handle. However, it is possible in that case for the encoder, which the user carries with him or her, to be too far away from the exterior mirror, with the result that the encoder does not receive the request signal. That is the case particularly when the user carries the encoder in a pocket on the side remote from the side mirror.

SUMMARY OF THE INVENTION

It is accordingly an object of the invention to provide an access control device for a motor vehicle and a method for setting the sensitivity of an access control device, which overcome the hereinafore-mentioned disadvantages of the heretofore-known devices and methods of this general type, in which the access control device rapidly identifies a user's desire for access and reliably carries out a question-answer dialog, and in which the method ensures that interference signals only slightly affect the question-answer dialog or not at all.

With the foregoing and other objects in view there is provided, in accordance with the invention, in a motor vehicle having at least one door with a door surface, at least one door handle, and at least one locking unit, an access control device for the motor vehicle, comprising a transmitting and receiving unit disposed at the vehicle for transmitting a request signal and for receiving a reply signal; an evaluation unit in the transmitting and receiving unit for comparing the reply signal with an expected code signal and for controlling the at least one locking unit in dependence on a result of the comparison; a portable encoder for receiving the request signal, for returning a coded reply signal, and for demonstrating authorization of or enabling a user carrying the encoder to lock and unlock at least one locking unit; and a transmitting and receiving antenna connected to the transmitting and receiving unit, the antenna having cores and at least two coils each wound onto a respective-one of the cores, the coils disposed in at least one door handle at a distance from the door and at an inclination relative to the door surface.

In this case, the access control device has a transmitting and receiving antenna formed from a plurality of individual coils. The coils are approximately cylindrical and are disposed in the door handle with their axes inclined at an angle with respect to one another. This has the advantage of producing a widely fanned radiation characteristic of the antenna, depending on the installed position of the coils. As a result, the encoder which is situated in the vicinity reliably receives the request signal that is transmitted with the aid of the magnetic field.

In accordance with another feature of the invention, there is provided a switch disposed on or in the door handle or in proximity to the door handle. Through the use of this switch, the user can trigger the question-answer dialog in a simple manner by actuating the door handle. The request signal is transmitted to the encoder in that dialog.

In accordance with a further feature of the invention, a plurality of coils are disposed in each of the door handles of both the front and rear doors and then if the encoder is situated outside the motor vehicle in the region of the rear doors, it is also addressed.

In accordance with an added feature of the invention, the individual coils are driven electrically differently in terms of amplitude and phase, so that differently resulting magnetic fields are produced. Consequently, the radiation characteristic of the antenna can be altered if the encoder does not receive the request signal even though it is close enough to the motor vehicle.

In accordance with an additional feature of the invention, the coils are disposed along the door handle in such a way that their axes are disposed at an obtuse angle with respect to one another. This gives rise to a magnetic field extending away from the motor vehicle (with a great depth).

In accordance with yet another feature of the invention, a plurality of coils are disposed with each of their axes perpendicular to the door handle. This gives rise to a widely fanned magnetic field.

With the objects of the invention in view, there is also provided a method for setting the sensitivity of an access control device, which comprises increasing a reception sensitivity of the portable encoder if a request signal can be expected and the encoder previously received an advance signal for that purpose with increased transmission power from the transmitting and receiving unit at the motor vehicle; and reducing the reception sensitivity of the encoder a period of time after transmission of a reply signal or after reception of a special signal.

In accordance with a concomitant mode of the invention, there is provided a method which comprises transmitting the advance signal with a considerably increased transmission power in comparison with the subsequent request signal.

The sensitivity of the access control device is set by the request signal being preceded by an advance signal having a considerably increased transmission power. If the advance signal is identified by the encoder, then the reception sensitivity of the encoder is increased for a period of time.

Consequently, further request signals with small levels are also received. Interference signals, which are constantly present at a certain level, in this case have no effect or only little effect. on the process of the question-answer dialog, as long as the levels of the interference signals are smaller than the reception level. It is advantageous for the subsequent request signal to be transmitted with a lower transmission power, so that energy is saved during transmission. Likewise, components are disburdened or relieved due to a smaller current load. A high continuous load endurance capacity is not required, thereby enabling all of the components to be configured to be smaller and simpler. The electrical voltages across components can be rated lower, which means that a risk to the user of electric shock is ruled out.

Other features which are considered as characteristic for the invention are set forth in the appended claims.

Although the invention is illustrated and described herein as embodied in an access control device for a motor vehicle and a method for setting the sensitivity of an access control device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
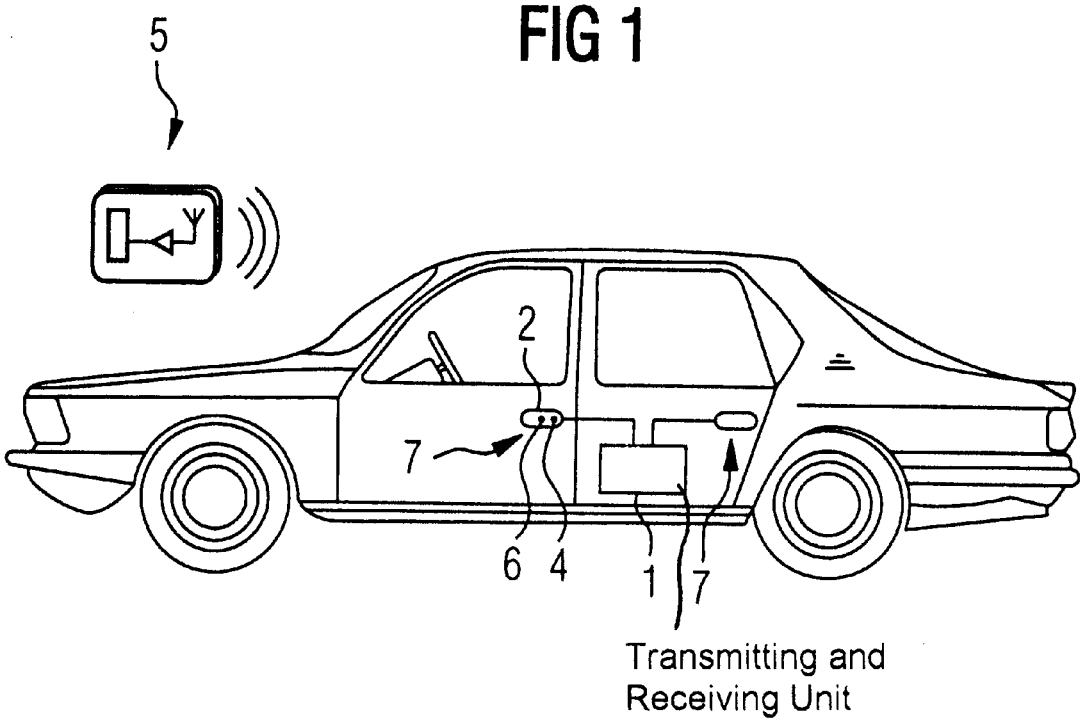
FIG. 1 is a diagrammatic, side-elevational view of a motor vehicle with an access control device according to the invention.

Referring now to the figures of the drawings in detail and first, particularly, to FIG. 1 thereof, there is seen a transmitting and receiving unit 1 of an access control device for a motor vehicle. The transmitting and receiving unit 1, which is disposed in the vehicle, can transmit a coded request signal 3 (seen in FIG. 7) and receive a coded reply signal through one or more antennas 2. The transmitting and receiving unit 1 contains an evaluation unit in which the received reply signal is compared with a stored, expected desired code signal. If the two signals correspond, then a control signal is generated, through the use of which one or more door locks 4 or a tailgate lock are locked or unlocked. An immobilizer can also then be released in order to permit the motor vehicle to be started.

A portable encoder 5 is used to demonstrate authorization to lock or unlock the door locks 4 in an authorized manner. The encoder 5 automatically returns a coded reply signal after receiving the request signal 3. The reply signal is encrypted and can change its coding each time it is transmitted anew (in accordance with a so-called changing code or a cryptocode).

In order to trigger the request signal 3, the access control device has a switch 6 disposed in or on a door handle 7 or in proximity to the handle 7. When a user comes to his or her motor vehicle, first of all he or she actuates this switch 6 manually. As soon as the switch is actuated, the request signal 3 is transmitted through the antennas 2. If the user is carrying his or her encoder 5 with him or her and the encoder 5 actually receives the request signal 3, then the encoder 5 returns its coded reply signal.

The switch 6 may be a mechanical pushbutton switch, a touch switch, a proximity switch, a pyroelectric switch or the like. The configuration of the switch 6 is not important in this case, rather the fact that the request signal 3 is transmitted when the switch 6 is actuated is important.

The antenna 2 of the transmitting and receiving unit 1 in the motor vehicle is disposed at least in one door handle 7. In this case, the antenna 2 includes at least two coils 9 (see FIGS. 2 and 3), which are usually wound radially around a coil core 10 that is in the form of a bar, cylinder or tube and is made of a ferrite material with high permeability ($\mu_r$>>1). The antennas 2 are therefore also referred to as ferrite antennas.

Figure 2:
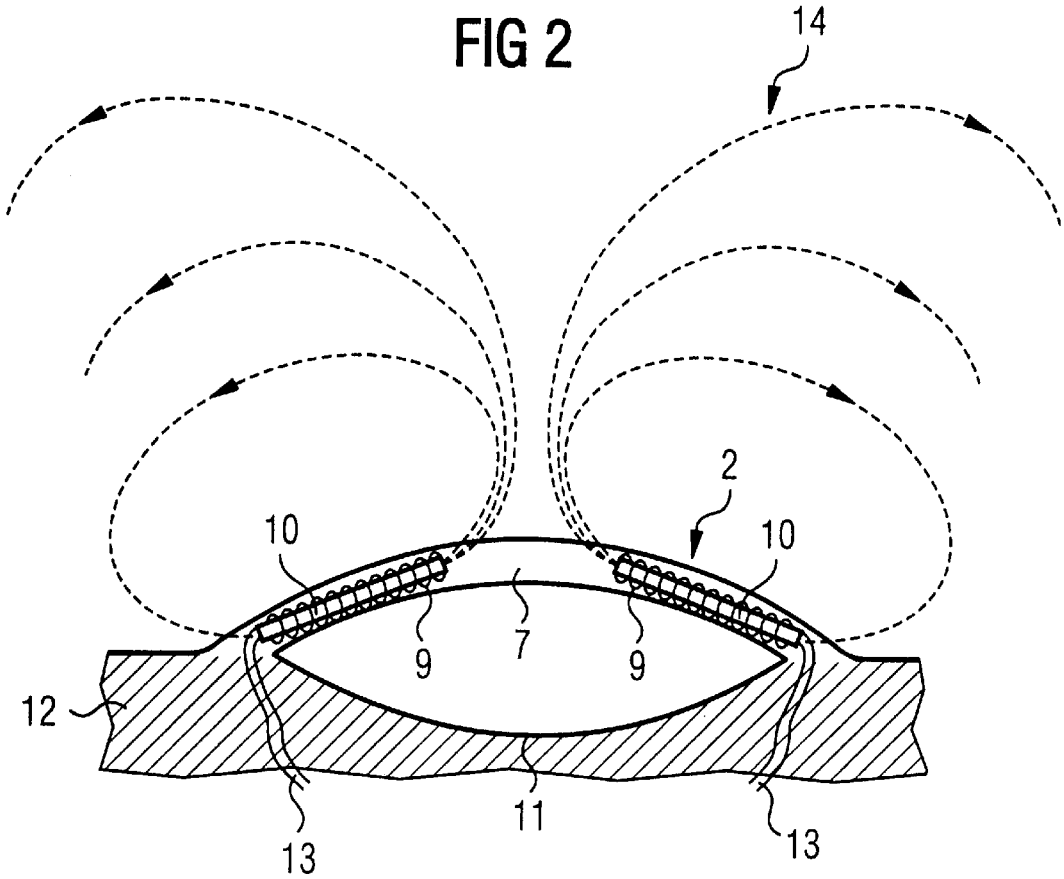
FIG. 2 and FIG. 3 are fragmentary, horizontal-sectional views of a door handle of the motor vehicle according to FIG. 1.

In this case, the coils 9 may be disposed longitudinally in a door handle 7, as is illustrated in FIG. 2. Axes of the coils 9 are inclined with respect to a surface of the door and in this case form an angle of considerably greater than 0° and considerably less than 180° with respect to the door surface. In this case, the door handle 7 may be constructed in any desired, convex or concave form. In addition, there may also be a recessed grip 11 in the region of the door handle 7, in order to permit the user to be better able to place his or her hand into the door handle 7 in order to open a door 12. Connections 13 of the coils 9 are electrically connected to the transmitting and receiving unit 1, from where the coils 9 are controlled by a corresponding alternating signal.

The coils 9 are always at a distance from a metal panel of the door 12 and are inclined at an angle with respect to the door surface in the region of the door handle 7. The coils 9 are typically driven electrically in such a way that they generate magnetic fields 14 in opposite senses (see arrows of the magnetic field lines). This gives rise to a resulting overall magnetic field which emerges from the door handle 7 and is essentially directed away from the motor vehicle. Since a magnetic field is involved, its range is limited (approximately 1 to 2 m around the door handle 7).

In this context, the range is to be understood to mean the distance to which a signal is still powerful enough to just still be able to be received or detected in an entirely satisfactory manner. The range thus also depends on the reception sensitivity.

The range can be increased by the antenna 2 being controlled with more power, by the encoder 5 having a higher reception sensitivity, by the quality of each antenna 2 being increased by exact production of the winding, better configuration of the ferrite material or by changing the mounting location, or by one or more antennas 2 being disposed further away from the door panel.

The spatial distribution of the magnetic field lines (and therefore the radiation characteristic of the antennas 2) can be altered by placing the coils 9 closer together or further away from one another. Furthermore, altering the angle of the axes of the coils 9 with respect to one another changes the radiation characteristic. A different radiation characteristic can also be obtained by changing the permeability of the material of the coil core 10 or the electrical driving of the coils 9.

In the case of the configuration of the coils 9 according to FIG. 2, a deep magnetic field 14 is obtained, that is to say the magnetic field 14 is narrow parallel to the longitudinal axis of the motor vehicle and extends away from the motor vehicle, preferably in the perpendicular direction.

Figure 3:
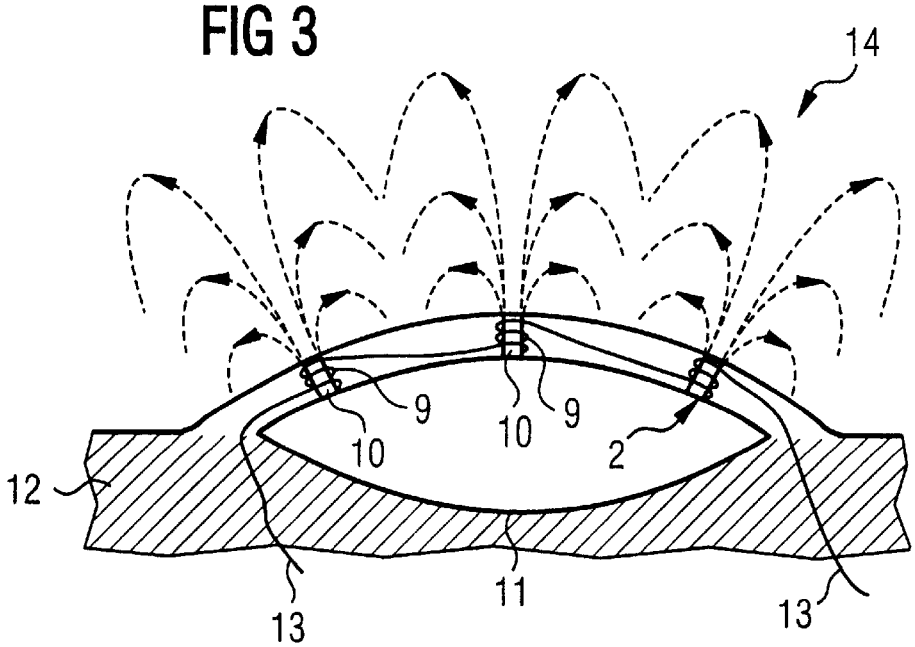

In accordance with FIG. 3, it is seen that the coils 9 can be disposed with their axes perpendicular to the door handle 7 as well. In this case, the individual coils 9 are disposed with their axes approximately radially in the convex door handle 7. If the coils 9 are driven electrically in the same sense (series-connected coils 9), then a very wide resulting magnetic field 14 is produced. In other words, the magnetic field 14 extends essentially parallel to the longitudinal axis of the vehicle and has a relatively small depth in the perpendicular direction away from the motor vehicle. Thus, the magnetic field 14 is formed in such a way that it is essentially narrow in the entire outer region of the corresponding door 12. The coils 9 can also be concentrated at one end of the door handle 7, thereby producing an asymmetrical magnetic field strength distribution which is utilized, for example, to cover a region to the side of the door handle by a stronger magnetic field 14 in that region. That region is preferably occupied by the encoder 5.

Figure 6:
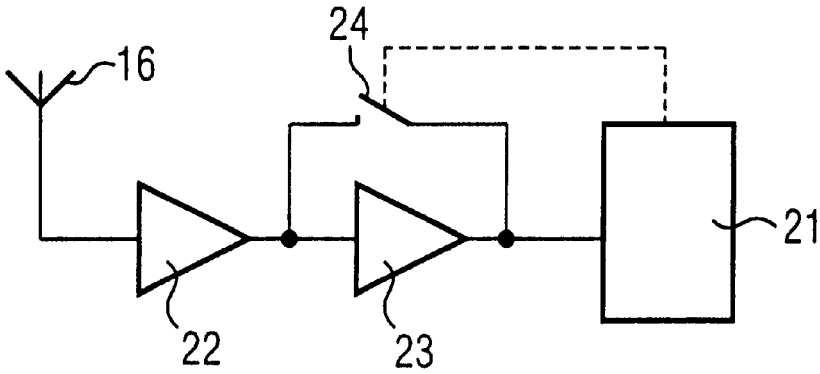
FIG. 6 is a block diagram of an input circuit of a portable encoder.

If the portable encoder 5 is disposed within the magnetic field 14, then a voltage is induced in its receiving antenna 16 seen in FIG. 6. If the induced voltage is large enough, then the reply signal is generated and returned. The reply signal can be received by the coils 9 or by another antenna in the motor vehicle and forwarded to the transmitting and receiving unit 1. The reply signal is then evaluated and checked in an evaluation unit of the transmitting and receiving unit 1 with respect to its authorization (this is also referred to as authentication) by being compared with an expected, stored code signal.

If the coils 9 are disposed in the door handle 7, then they are at a fixed distance from the panel of the door 12. Electrically conductive or magnetically permeable materials in proximity to the coils 9 attenuate the magnetic field generated by the latter or concentrate the magnetic field lines in themselves. Therefore, it is advantageous if the coils 9 are placed at the greatest possible distance from the door panel. Accordingly, the coils 9 are disposed in the door handle in such a way that they are as far away from the door panel as possible. More field lines pass into the space outside the motor vehicle if the coils 9 are disposed with their axes (corresponding to the longitudinal axis of the coil core 10) at an inclination with respect to the surface of the metallic door.

Figure 4:
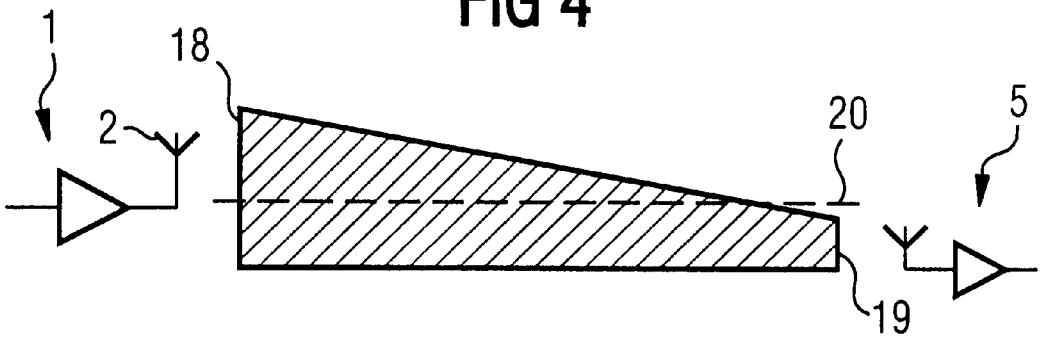
FIG. 4 and FIG. 5 are illustrations of transmission levels of a transmitting and receiving unit of the access control device.
Figure 5:
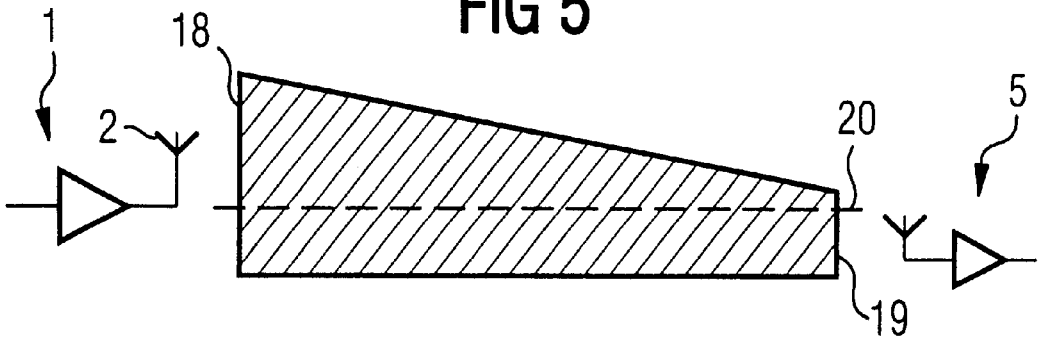

In accordance with FIGS. 4 and 5, the magnetic field 14 generated by the coils 9 decreases appreciably with increasing distance from the coils 9. If the coil 9 transmits with a specific transmission power or a transmission level 18 (corresponding to the strength of the magnetic field 14 at the location of the coil 9, or amplitude), then the encoder 5, given a distance from the coil 9, receives a smaller level (equal to a reception level 19 and corresponding to the strength of the magnetic field at the location of the encoder 5). If, in accordance with FIG. 4 (where the level of a transmission signal is plotted against the distance from the antenna 9), the reception level 19 lies below an interference level 20 (represented by dashed lines in the figures) caused by random interference signals, then the interference signals can impair the reception of the request signal 3. The request signal 3 can then no longer be received in an entirely satisfactory manner and, consequently, a reply signal cannot be returned either.

If the transmission level 18 is sufficiently high, in accordance with FIG. 5, then the probability of the reception level 19 lying above a prevailing interference level 20 is also higher. Consequently, the request signal 3 can more likely be received in an entirely satisfactory manner. The same effect is obtained if, instead of the higher transmission level 18, the reception sensitivity of the encoder 5 is altered.

Since it saves more energy to alter the reception sensitivity of the encoder 5, the sensitivity is increased during the transmission of the request signal 3. For this purpose, an input circuit of the encoder 5 is altered in accordance with FIG. 6. As soon as an advance signal having a reception level 19 lying above a threshold value (see FIG. 7 where power I or amplitude is plotted against time t) is received, a second preamplifier 23 is switched in through the use of a bypass switch 24 upstream of an evaluation unit 21 of the encoder 5, in addition to a first preamplifier 22. Consequently, the two preamplifiers 22, 23 are active and the encoder 5 has a high reception sensitivity.

Instead of using the preamplifier 23 that can be bypassed, it is also possible to set a variable gain of the preamplifier 22. The encoder 5 has a higher reception sensitivity in the case of high gain and a lower sensitivity in the case of low gain. This has the advantage of permitting the reception sensitivity to be set between very large and very small values. Consequently, initial values for the gain can also be set for the encoder 5, with the result that the range can be set identically for each encoder 5 assigned to the motor vehicle.

If the motor vehicle is locked and the encoder 5 is not required, then the reception sensitivity is low. In this case, the second preamplifier 23 is bypassed by the closed bypass switch 24. The quiescent current consumption of the encoder 5 is thus lower. Interference signals having a low interference level cannot "wake up" the encoder 5, rather only powerful signals can.

Figure 7:
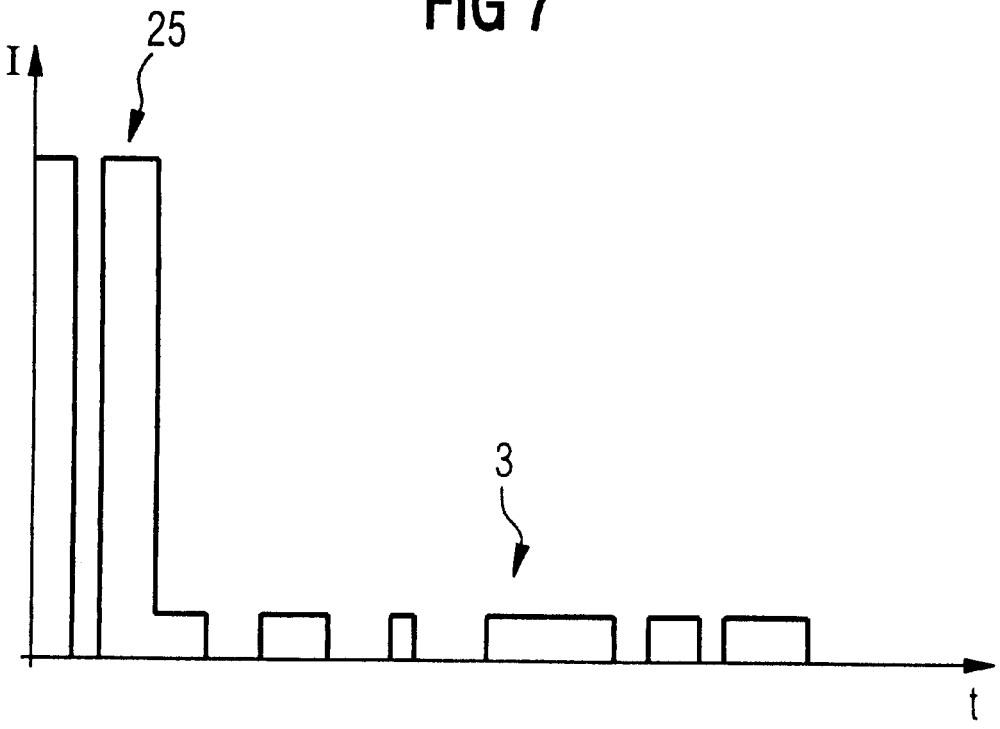
FIG. 7 is a graph of a digital request signal.

If, in accordance with FIG. 7, an advance signal 25 having a momentary, very large power is received, then the encoder 5 is switched to be more sensitive again in order to correctly receive the subsequent request signal 3. The request signal 3 is then evaluated. In the event of a correct request signal 3, the reply signal is subsequently generated and transmitted.

The reception sensitivity of the encoder 5 need only be increased until the reception sensitivity has switched over again to the less sensitive region. The request signal 3 itself can then be transmitted with low transmission power, in the case of high sensitivity of the encoder 5.

The reception sensitivity can then be increased as soon as the advance signal 25 has been received or as soon as a predetermined time period has elapsed since reception of the advance signal 25.

Consequently, the encoder 5 starts to become active only when it has received an advance signal 25 having a correspondingly large transmission level 18. Interference signals having interference levels 20 which are smaller than the reception level 19 of the advance signal 25 do not affect the encoder 5 and thus the transmission of a reply signal. It is only powerful interference signals that could cause the encoder 5 to be incorrectly activated.

Consequently, energy is advantageously saved in the transmitting and receiving unit 1 during the transmission of the request signal 3 and in the encoder 5 during the reception of the request signal 3. This is advantageous principally when the encoder 5 has its own battery to supply it with power, and the capacity of that battery is only very limited due to the small dimensions of the encoder 5.

The encoder 5 is not activated as often, in some instances unintentionally, by virtue of the low reception sensitivity in the quiescent state. The encoder could be unintentionally activated by mobile telephones, for example. The energy storage device of the encoder 5 is disburdened or relieved as a result of the variable reception sensitivity.

The advance signal 25 may be a single pulse having a defined, high transmission level 18 and a defined duration (for example 3 ms). The advance signal 25 may additionally have a binary coding as well, which is used to identify whether an advance signal 25 is actually involved or just an interference signal having a very high interference level 20.

The sensitivity of the encoder 5 can be reversed again at a period of time after the start of the request signal 3. The period of time in this case is chosen in such a way that the request signal 3 has been reliably received. The sensitivity can also be reversed again after the transmission of the reply signal. The sensitivity can also be reversed when a separate special signal is received. The special signal indicates to the encoder 5 that the increased reception sensitivity is no longer required.

Instead of the period of time, the switch-over to the low sensitivity may also be coupled to an operating mode, e.g. the sensitivity can be lowered 30 s after the locking of the motor vehicle. The locking of the motor vehicle is assumed to be an operating mode in this case.

A plurality of coils 9 (that is to say in each case one antenna 2) can be disposed in each door handle 7 (including a tailgate handle) of each vehicle door. Placing the antennas 2 in the door handles of the front door on the driver's side and the rear door on the driver's side, gives rise to an overall magnetic field, approximately ⅓ of which is a superposition field of the two antennas 2, since the two antennas 2 are spaced apart from one another by approximately 1 m (in each case in the door handles 7). The superposition field has a greater range and is disposed in particular in the region of a B-pillar of the motor vehicle. This is the region principally occupied by the user when he or she attempts to demonstrate his or her authorization for access to the vehicle before he or she can enter his or her vehicle.

The resulting magnetic field 14 can be formed in a more defined manner, if more coils 9 are disposed in a door handle 7. In this case, the coils 9 can be disposed in such a way that the probable location occupied by the encoder 5, which the user carries with him or her, is reliably permeated by he magnetic field 14. The coils 9 cannot only be inclined in a horizontal plane with respect to the door 12, but also at an inclination with respect thereto. The coils 9 can also be inclined at a different angle both horizontally and vertically.

For this purpose, however, the door handle 7 must be constructed with a corresponding thickness. The door handle 7 may be constructed as a hoop, stationary handle, as a pulling handle or as a pivotable flap. The door handle 7 may also be constructed to be movable, for example in such a manner that it can pivot or be pulled out. What is important in any event is that the door handle 7 provide sufficient installation space for the coils 9. The external shape of the door handle 7 in this case may be convex, straight or concave.

The door handle 7 can be produced from an electrically conductive material or from an electrically insulating material. The material of the door handle 7 must not influence the magnetic field 14 too much, in order to ensure that the access control device can operate as effectively as possible.

If the coils 9 are constructed as ferrite antennas with a ferrite core, then it is advantageous if the ferrite material has very high permeability. Consequently, the coils 9 can be constructed to be very small (less than 1 cm in length) and to fit well into the door handle 7.

The individual coils 9 can be driven differently electrically in terms of amplitude and phase, whereby differently resulting magnetic fields 14 (interference fields) are produced. Consequently, the radiation characteristic of the antenna 2 can be altered in a simple manner if the encoder 5 initially does not receive the request signal 3 even though it is close 20 enough to the motor vehicle. This may be the case when the encoder 5 happens by chance to be in a "valley" (superposition amplitude approximately zero) or in a so-called zero of the superposed magnetic field.

The coils 9 can be controlled jointly (in a series circuit) or separately from one another (in each case connected to the transmitting and receiving unit 1 in parallel).

The encoder 5 may be constructed in the form of a smart card or be accommodated in a handle of a conventional key. On one hand, its configuration is not essential to the invention. What is essential, on the other hand, is that the encoder automatically return a reply signal if it has previously received a request signal 3. Therefore, the encoder 5 may also be referred to as a transponder.

I claim:

1. In a motor vehicle having at least one door with a door surface, at least one door handle, and at least one locking unit, an access control device for the motor vehicle, comprising:

a transmitting and receiving unit disposed at the vehicle for transmitting a request signal and for receiving a reply signal;

an evaluation unit in said transmitting and receiving unit for comparing the reply signal with an expected code signal and for controlling the at least one locking unit in dependence on a result of the comparison;

a portable encoder for receiving the request signal, for returning a coded reply signal, and for demonstrating authorization of a user carrying the encoder to lock and unlock at least one locking unit; and a transmitting and receiving antenna connected to said transmitting and receiving unit, said antenna having cores and at least two coils each wound onto a respective one of said cores, said coils disposed in at least one door handle at a distance from the door and at an inclination relative to the door surface and relative to one another.

2. The access control device according to claim 1, including a trigger switch disposed at the at least one door handle and electrically connected to said transmitting and receiving unit, for triggering the request signal in the event of actuation of said trigger switch.

3. The access control device according to claim 1, including a trigger switch disposed in proximity to the at least one door handle and electrically connected to said transmitting and receiving unit, for triggering the request signal in the event of actuation of said trigger switch.

4. The access control device according to claim 1, wherein the at least one door includes a front door and a rear door, the at least one door handle includes a front door handle and a rear door handle, and said at least two coils include a plurality of coils disposed in each of said door handles of the front door and the rear door.

5. The access control device according to claim 1, wherein said transmitting and receiving unit drives said coils differently in terms of amplitude and phase, to produce differently resulting magnetic fields.

6. The access control device according to claim 1, wherein said antenna is one of a plurality of antennas, and said transmitting and receiving unit drives said antennas differently in terms of amplitude and phase, to produce differently resulting magnetic fields.

7. The access control device according to claim 1, wherein said antenna is one of a plurality of antennas, and said transmitting and receiving unit drives said antennas and said coils differently in terms of amplitude and phase, to produce differently resulting magnetic fields.

8. The access control device according to claim 1, wherein the at least one door handle includes at least one convex door handle, and said cores for at least two of said coils are formed of a ferrite material, are disposed along the convex door handle and have axes disposed at an obtuse angle relative to one another.

9. The access control device according to claim 1, wherein the at least one door handle includes at least one convex door handle, and a plurality of said coils have axes perpendicular to the convex door handle.

10. A method for setting the sensitivity of an access control device according to claim 1, which comprises:

increasing a reception sensitivity of the portable encoder if a request signal can be expected and the encoder previously received an advance signal for that purpose with increased transmission power from the transmitting and receiving unit at the motor vehicle; and reducing the reception sensitivity of the encoder a period of time after transmission of a reply signal or after reception of a special signal.

11. The method according to claim 10, which comprises transmitting the advance signal with an increased transmission power in comparison with the subsequent request signal.

* * * * *